US006318013B1

(12) United States Patent
Cope

(10) Patent No.: US 6,318,013 B1
(45) Date of Patent: Nov. 20, 2001

(54) INFLATABLE DISPLAY DEVICE

(76) Inventor: Dennis Cope, 7318 Dunbar Rd., Crossville, TN (US) 38555

( * ) Notice: Subject to any disclaimer, the term of this patent is extended or adjusted under 35 U.S.C. 154(b) by 0 days.

(21) Appl. No.: 09/225,626

(22) Filed: Jan. 5, 1999

(51) Int. Cl.[7] ..... A47G 1/06; A63H 3/06
(52) U.S. Cl. ..... 40/736; 40/214; 446/222
(58) Field of Search ..... 244/31, 33; 446/220, 446/221, 222; 40/212, 214, 217, 736; 5/710, 712

(56) References Cited

U.S. PATENT DOCUMENTS

| | | | | |
|---|---|---|---|---|
| 2,383,390 | | 8/1945 | Jacobs . | |
| 2,681,142 | * | 6/1954 | Cohen | 206/522 |
| 3,771,247 | * | 11/1973 | DeHarak | 40/736 |
| 4,693,695 | * | 9/1987 | Cheng | 446/220 |
| 4,837,955 | * | 6/1989 | Grabhorn | 40/661 X |
| 4,874,093 | | 10/1989 | Pharo . | |
| 4,877,224 | | 10/1989 | Watts . | |
| 4,877,334 | | 10/1989 | Cope . | |
| 4,949,530 | | 8/1990 | Pharo . | |
| 5,254,026 | | 10/1993 | Kaiser . | |
| 5,272,856 | | 12/1993 | Pharo . | |
| 5,447,235 | | 9/1995 | Pharo . | |
| 5,451,179 | * | 9/1995 | LaRoi, Jr. et al. | 446/224 |
| 5,588,532 | | 12/1996 | Pharo . | |
| 5,727,270 | | 3/1998 | Cope et al. . | |

* cited by examiner

*Primary Examiner*—Brian K. Green
(74) *Attorney, Agent, or Firm*—Baker Botts L.L.P.

(57) ABSTRACT

A self-sealing, self-standing fluid container for displaying product comprises at least two inflatable cells, each cell comprising an outer and inner layer of fluid impermeable material sealed together by a first seal at the layers' periphery such that the seal between the outer and inner layers defines boundaries of each inflatable cell, and the inner layers of the first and second cells being sealed together by a second seal to form a pair of cells and a pouch between said pair of cells, the pouch having a sealable opening for receiving product for display.

4 Claims, 3 Drawing Sheets

INFLATABLE DISPLAY DEVICE

BACKGROUND OF INVENTION

The present invention relates to inflatable containers which can hold a fluid or gas, and specifically to those containers which can be used as a display device. There are many devices and patents issued directed to inflatable bags and self-sealing containers. The applicant is the named inventor on many such patents, including recently issued U.S. Pat. No. 5,727,270 entitled "Valveless Self-Sealing Fluid and Gas Container." There are many others including those issued to Daniel Pharo, specifically U.S. Pat. Nos. 4,877,334; 4,874,093; 4,949,530; 5,272,856; 5,447,235; and 5,558,532. Few patents have issued directed to display balloons, but these include U.S. Pat. No. 2,383,390 and 5,254,026.

It is an object of this invention to provide numerous improvements and advantages over all such prior art and particularly to provide an improved self-sealing inflatable container capable of effectively working as a self-standing display.

Other objects and purposes will be apparent to those skilled in the art upon review of the detailed description of the invention.

SUMMARY OF THE INVENTION

The invention has many embodiments and includes a self-sealing fluid container for displaying product. As will be discussed in greater detail below the fluid container comprises at least two inflatable cells, each cell comprising an outer and inner layer of fluid impermeable material sealed together by a first seal at the layers' periphery such that the seal between the outer and inner layers defines boundaries of each inflatable cell. The inner layers of the first and second cells me sealed together by a second seal to form a pair of cells and a pouch between said pair of cells, the pouch having a resealable opening for receiving product for display. Preferably, the second seal is removed inwardly from the periphery so that the distance between the seals is sufficient to allow the container to be self-standing—where the ends of each cell act as legs supporting the container.

Alternatively, the inner layers of the first and second cells are cut out (or truncated) and sealed by a second seal at one end and forming a loop at an opposite end. The loop forms a pouch having a sealable opening for receiving product for display. When the term "sealable" is used herein, it is meant to include (but not necessarily) resealable openings so that products can repeatedly be inserted and removed. The inner layers of the first and second cells may also be cut and sealed by a second seal at opposite ends and forming an area for receiving a product for display.

In yet another embodiment, the pair of cells share a common inner translucent layer, the outer layer of one of said cells is clear and the outer layer of said other cell is reflective. The reflector cell preferably defines a light chamber for holding a light source, and the clear cell preferably defines a product chamber for disclosing an "illuminated" product.

BRIEF DESCRIPTION OF THE DRAWINGS

Further objects, features and advantages of the invention will become apparent from the following detailed description taken in conjunction with the accompanying figures showing illustrative embodiments of the invention, in which.

DETAILED DESCRIPTION OF THE INVENTION

Figure 2:
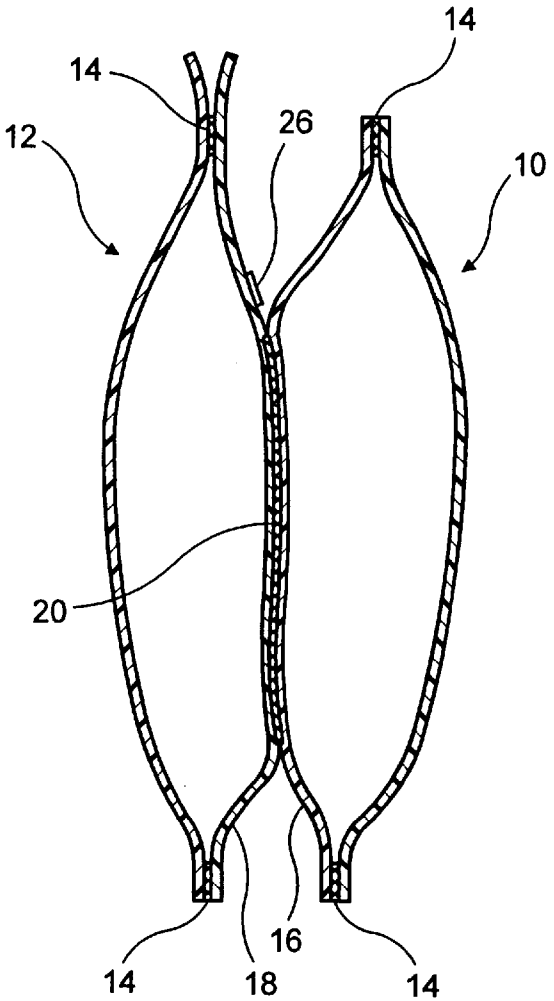
FIG. 2 is a cross-section view taken along lines 2—2 in FIG. 1 after inflation.
Figure 1:
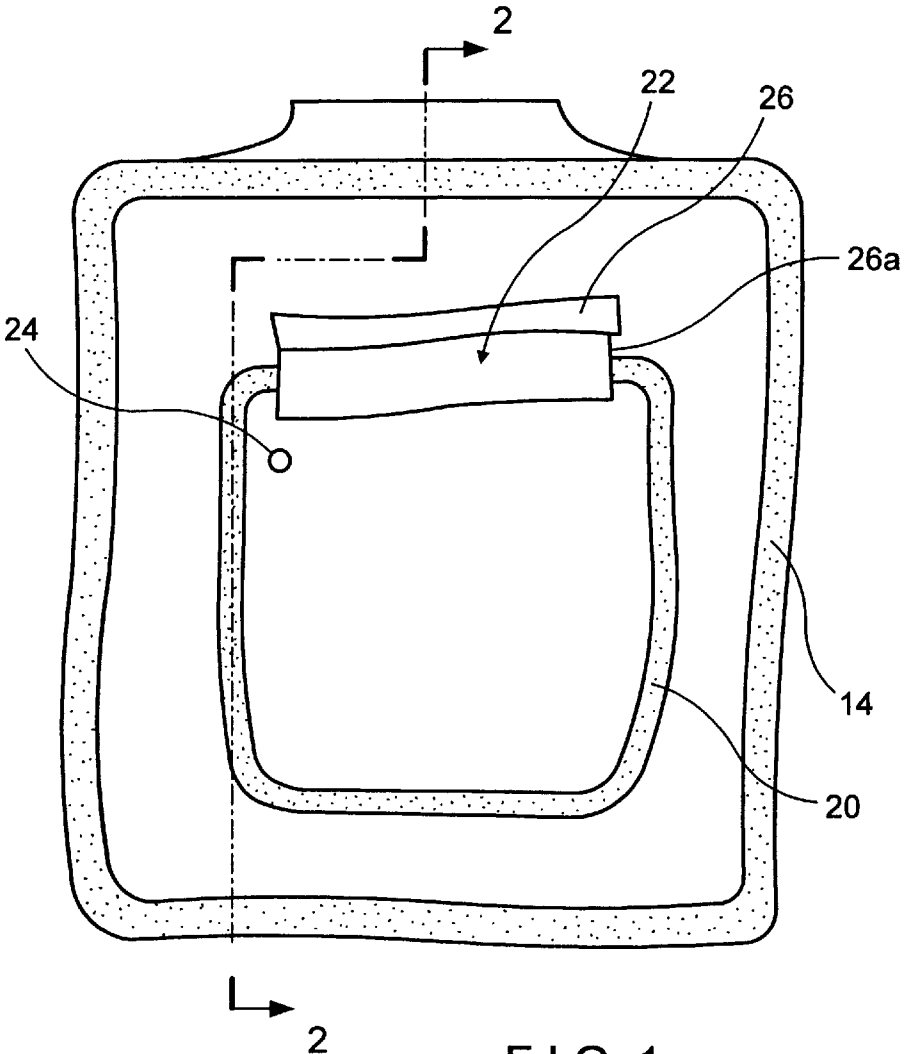
FIG. 1 is a top view of a self-sealing, self-standing display container with pouch of the present invention prior to inflation.

FIGS. 1 and 2 illustrate a self-sealing, self-standing display container in accordance with the first embodiment of the invention, which includes a pouch for displaying product. The device includes front and rear balloon sections or cells 10, 12. Each balloon section or cell includes two layers joined preferably at an outer heat seal 14, which defines the boundaries of each cell. The inner layers 16, 18 of the balloon sections 10, 12 are also joined at an inner heat seal 20. An opening 22 is provided at the top of the inner heat seal 20 so as to form a pouch for receiving articles to be displayed. The pouch formed underneath the opening 22 is preferably made of an elastic material to better accommodate 3-dimensional objects. A port 24 is preferably provided between the balloon sections or cells 10, 12 so that air is used to simultaneously inflate both balloon sections 10, 20. Port 24 can be placed anywhere inside the heat seal area, and also within the heat seal itself.

A portion of double back tape 26 (e.g., a sealing element) (preferably with a closure flap 26*a* comprising a film heat seal on one side only) is also preferably provided over the opening 22 and can be used to seal (and reseal) the inner layers 16, 18 together once an object is placed into the pouch. This also prevents the inner heat seal 20 from being torn. The double back tape can be placed on either layer 16 or 18, the flap 26*a* being heat sealed on the opposite layer. The flap 26*a* creates a shear pull on the tape and puts all the "pull open" pressure on the heat seal. The flap also allows for the opening 22 at the heat seal from heat sealing during manufacture.

Preferably, by placing the second seal which seals the inner layers away from the periphery of the cells, the bottom portion of each balloon section forms a leg allowing the device to stand up on a counter top, or the like, for display purposes—the legs allow the device to be self-standing.

Alternatively, the container can be provided without a pouch and thus, no double back tape is necessary. In this case, instead of inserting a display into the pouch, a message can be printed directly on the middle sheets 16, 18.

Figure 3:
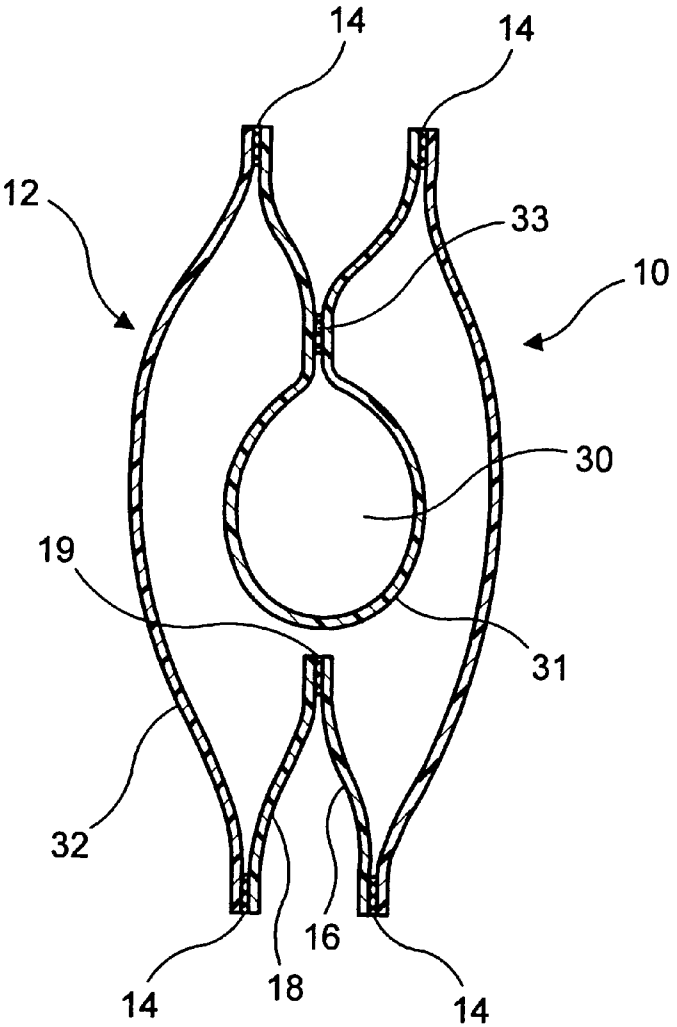
FIG. 3 is a cross-section view of a self-sealing, self-standing display container with a three-dimensional pouch of the present invention after inflation.

FIG. 3 further illustrates a self-sealing, self-standing display container with a three dimensional pouch for holding three dimensional items. In this case, the pouch 30 is formed in a 3-dimensional shape to better tolerate 3-dimensional objects. Inner sheets or layers 16, 18 are cut and sealed at one end 19 and a loop 31 is preferably formed at the opposite end 33. The loop forms pouch 30 hanging from sealable opening and stem 33, instead of the flat fixed envelope-type pouch of FIG. 1. Note that the balloon sections or cells 10, 12 in this embodiment are not completely separated from each other since the inner sheets and the seal between them is cut. The back sheet 32 of the second balloon section 12 is preferably opaque to help highlight the contents of the pouch 30. Double-back tape for reinforcement can be provided as in FIG. 1, but is not separately shown in FIG. 3.

Figure 4:
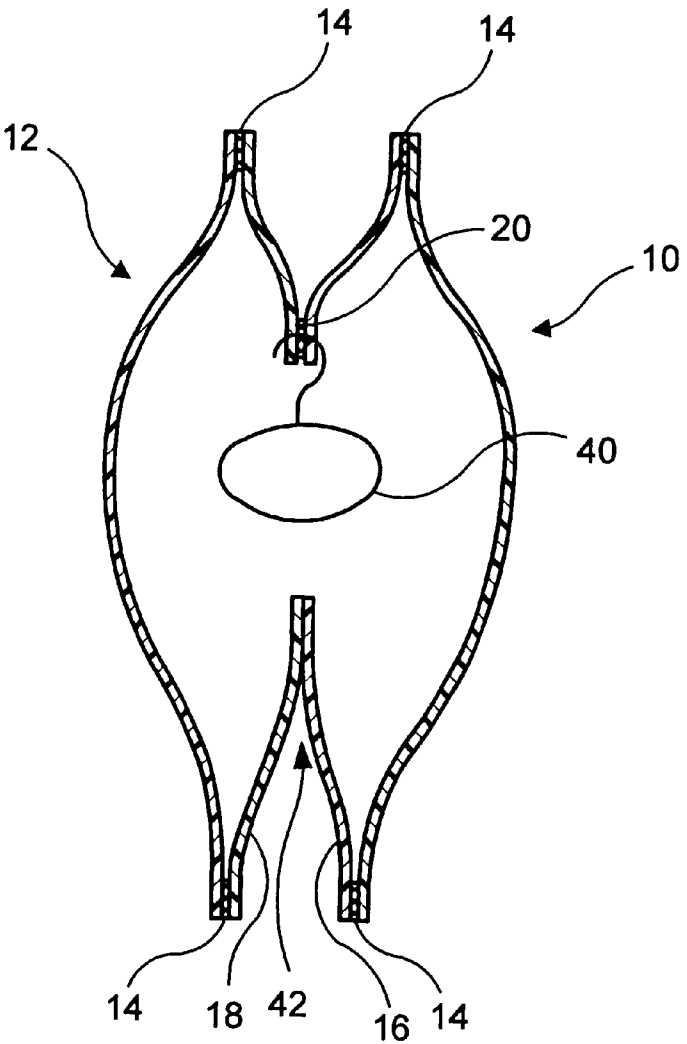
FIG. 4 is a cross-section view of the container shown in FIG. 3 together with another embodiment of the present invention after inflation.

With reference to yet another embodiment of the invention, please refer to FIG. 4. In this case, inner layers and the inner heat seal 20 are cut to allow hanging space for object 40. The object may hang from seal 20. A sealable opening 42 is provided between the inner layers 16, 18 to permit object 40 to be placed within the balloon. A "zip lock" type of closure, similar to that used in a plastic food storage bag, may be employed for the sealable opening 42. The "zip lock" may extend beyond the heat seal, or may instead be terminated within the heat seal, to enhance fluid integrity, and a supplemental double-back tape may be employed. The "zip lock" portion can be made from a special low density polyethylene which has "self-wetting" properties to assist in holding air. As before, the cells in this embodiment are not completely separated from each other.

Figure 5:
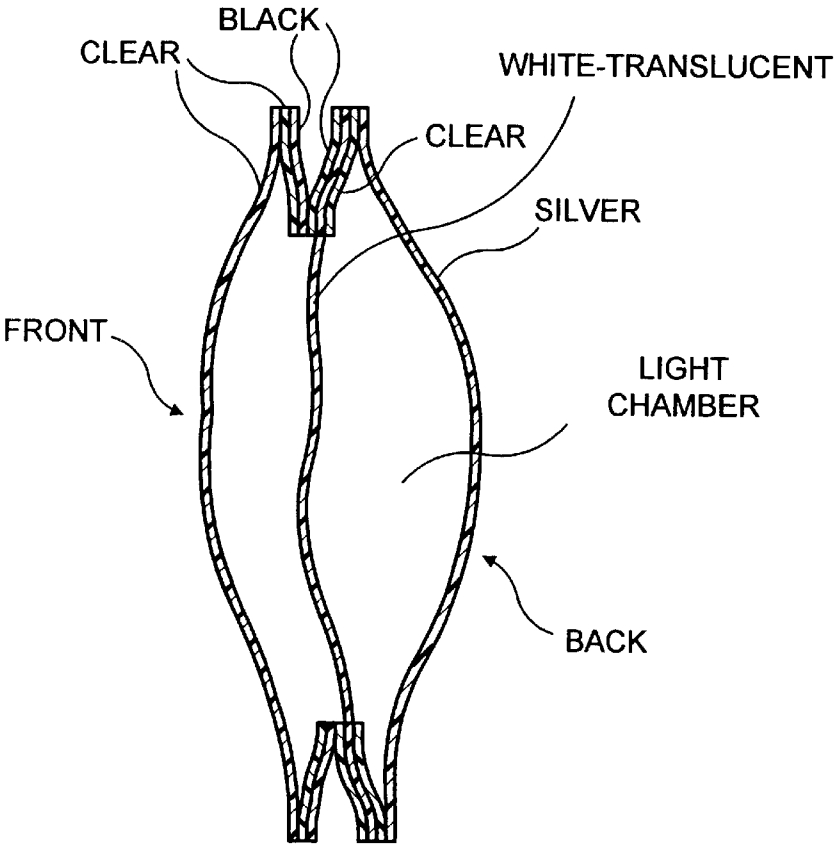
FIG. 5 is a cross-section view of a self-sealing, self-standing display container of another embodiment of the present invention after inflation.

FIG. 5 illustrates additional embodiments similar to those previously described, except as now described. In accordance with this embodiment of the invention the balloon cells share a common inner layer which is preferably made of a translucent white material to provide a "slide screen" effect. The outer layer of the front balloon section is clear and a black border is provided for both the front and rear balloon sections at the inner layer. The outer layer of the rear balloon section is made from a silver material which is silver on both sides and serves to reflect light through the white translucent layer. The rear balloon section contains a light chamber in which an electric light can be mounted. Specifically, the rear layer and thus the rear balloon cell is preferably provided with a small light pocket which can receive a so-called "grain of wheat" type of bulb, or something similar. The light could alternatively be placed right within the chamber and supplied with electricity through flat silver leads, Accordingly, an illuminated display is provided.

Figure 6:
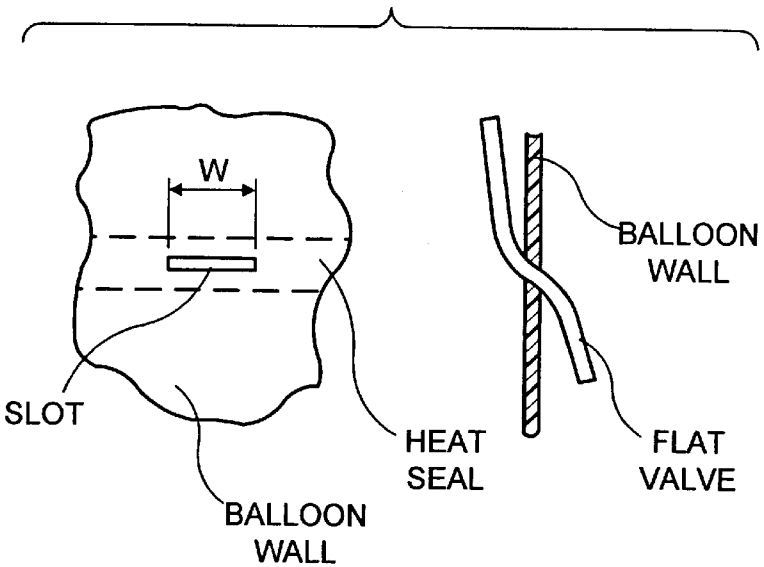
FIG. 6 is an illustrative view of a flat valve preferred for use with the various embodiments of the present invention.

A variety of valve devices can be used to introduce air into the balloon sections, as would be recognized by those skilled in the art. "Flat valves" are preferred, as shown in FIG. 6. A slot of width W is made in the balloon wall, with the distance W about the width of the flat valve. The flat valve is then inserted through the incision, and heat sealing is carried out over the incision, in order to obtain fluid integrity. If the slot is a little bit wider than the flat valve, the heat sealing causes the material to flow and close up any gaps. A special white high heat ink is preferably applied in the interior of the flat valve to prevent heat sealing of the valve itself. Thus, a passage remains wherein a straw or coffee stirrer can be inserted through the flat valve to inflate the balloon device.

The foregoing merely illustrates the principles of the invention. It will thus be appreciated that those skilled in the art will be able to devise numerous systems and methods which, although not explicitly shown or described herein, embody the principles of the invention and are thus within the spirit and scope of the invention.

I claim:

1. A self-sealing fluid container for displaying product comprising:

at least two inflatable cells, each cell comprising an outer and inner layer of fluid impermeable material sealed together by a seal at the layers' periphery such that said seal defines boundaries of each inflatable cell, the inner layers of the first and second cells being sealed together by a common seal to form a pair of said cells fixedly connected by said common seal; and wherein said fixed common seal has two ends with a space therebetween and said fixed common seal is removed from the layers' periphery and forms a pouch between said pair of cells, said pouch having an opening defined by the space between said two ends for receiving product for display; and wherein said fluid container is self-standing with use of said periphery seal and wherein said pouch includes a sealing element enabling said opening to be sealable.

2. The container of claim 1 wherein said sealable opening comprises double back tape at said opening.

3. The container of claim 2 wherein said pouch is made of elastic material.

4. A self-sealing fluid container for displaying a product comprising in combination a first sheet of a gas impervious flexible material, a second sheet of a gas impervious flexible material said first and second sheets being sealably joined together at the edges to provide a first sealed inflatable chamber disposed between said first and second sheets, a third sheet of a gas impervious flexible material, a fourth sheet of a gas impervious flexible material, said third and fourth sheets being sealably joined together at the edges to provide a second sealed inflatable chamber disposed between said third and fourth sheets, said second and third sheets being bonded together at a seal set inward of edge seals to attach first and second sealed chambers and to form a third chamber located between said second and third sheets and defined by said inward seal to receive one or more articles to be displayed; and wherein said third chamber includes a sealing element enabling said third chamber to be sealable.

* * * * *